US005341790A

United States Patent [19]

Ebert

[11] Patent Number: 5,341,790

[45] Date of Patent: Aug. 30, 1994

[54] GUN POWERED BY PRESSURIZED GAS AND/OR PRESSURIZED AIR

[75] Inventor: Gary F. Ebert, Walworth, N.Y.

[73] Assignee: Crosman Corporation, Bloomfield, N.Y.

[21] Appl. No.: 826,428

[22] Filed: Jan. 27, 1992

[51] Int. Cl.[5] ..... F41B 11/06; F41B 11/26; F41B 11/32

[52] U.S. Cl. ..... 124/69; 124/73; 124/74

[58] Field of Search ..... 124/69–71, 124/73, 74, 76

[56] References Cited

U.S. PATENT DOCUMENTS

| | | | |
|---|---|---|---|
| 1,214,398 | 1/1917 | Welch | 124/76 X |
| 1,818,810 | 8/1931 | Miller | 124/70 X |
| 2,652,821 | 9/1953 | Fitch | 124/69 X |
| 3,119,384 | 1/1964 | Merz | 124/74 X |
| 3,236,222 | 2/1966 | Pitcher | 124/74 |
| 3,741,189 | 6/1973 | Kester et al. | 124/74 X |
| 4,304,213 | 12/1981 | Jereckos | 124/69 |

FOREIGN PATENT DOCUMENTS

| | | | |
|---|---|---|---|
| 3704455 | 8/1988 | Fed. Rep. of Germany | 124/63 |

*Primary Examiner*—Randolph A. Reese
*Assistant Examiner*—John Ricci

[57] ABSTRACT

A gun can be powered by a cartridge of pressurized gas or by pressurized air. The gun includes a valve body which provides a pressure reservoir for storing pressurized gas or air. When the gun is fired, pressurized gas or air is discharged from the pressure reservoir and propels a projectile out of the barrel of the gun. An air pump is mounted on the gun for supplying pressurized air to the pressure reservoir. An adapter assembly is mounted on the gun for holding a cartridge of compressed gas. The adapter assembly includes an adapter housing and a plunger which is slidably mounted in the adapter housing. The plunger is movable between a sealing position in which the plunger sealingly engages the adapter housing and an exhaust position in which pressurized gas or air from the pressure reservoir can flow out of the adapter housing. The plunger is maintained in the sealing position by a gas cartridge or by a plug which can be screwed into the adapter housing. A check valve in the plunger permits pressurized gas to flow through the plunger into the pressure reservoir but prevents pressurized gas or air to flow from the pressure reservoir through the plunger.

23 Claims, 11 Drawing Sheets

GUN POWERED BY PRESSURIZED GAS AND/OR PRESSURIZED AIR

BACKGROUND

This invention relates to guns, and, more particularly, to a gun which can be powered by pressurized gas, by pressurized air, or by both pressurized gas and pressurized air.

Guns which are powered either by pressurized gas or by pressurized air are well known. Guns which are powered by pressurized gas are commonly called $CO_2$ guns and use a cartridge of pressurized $CO_2$ gas. Guns which are powered by pressurized air are commonly called air guns. Both types of guns generally include a valve body which stores a charge of pressurized gas or air. A BB, pellet, or other projectile is loaded into the barrel of the gun, and when the gun is fired, the charge of pressurized gas or air is discharged from the valve body and propels the projectile out of the barrel.

Heretofore, a gun was usually either a $CO_2$ gun or an air gun. A few guns have been provided which had the capability of being powered by either pressurized gas or pressurized air. However, those guns have usually required some modification of the gun, such as an exchange of parts, in order to adapt the gun to one mode or the other.

SUMMARY OF THE INVENTION

The invention provides a gun which can be powered by either pressurized gas or pressurized air or by both pressurized gas and pressurized air. Each type of power source has certain advantages and capabilities, and the user has the option of which power source he will use. The gun includes a valve body which can be pressurized by an air pump on the gun or by a $CO_2$ cartridge. The $CO_2$ cartridge is mounted in an adapter assembly. A check valve in the adapter assembly permits $CO_2$ gas to flow one way into the valve body but prevents pressurized gas or air from flowing the other way past the check valve. When the $CO_2$ cartridge is empty the air pump can pump pressurized air into the valve body, and the check valve will prevent the pressurized air from escaping through the adapter assembly. When the gun is to be powered by both $CO_2$ and air, the valve body will be pressurized by the $CO_2$ cartridge, and the pressure in the valve body can be increased by the air pump.

DESCRIPTION OF THE DRAWING

The invention will be explained in conjunction with an illustrative embodiments shown in the accompanying drawing in which—

DESCRIPTION OF SPECIFIC EMBODIMENT

Figure 1:
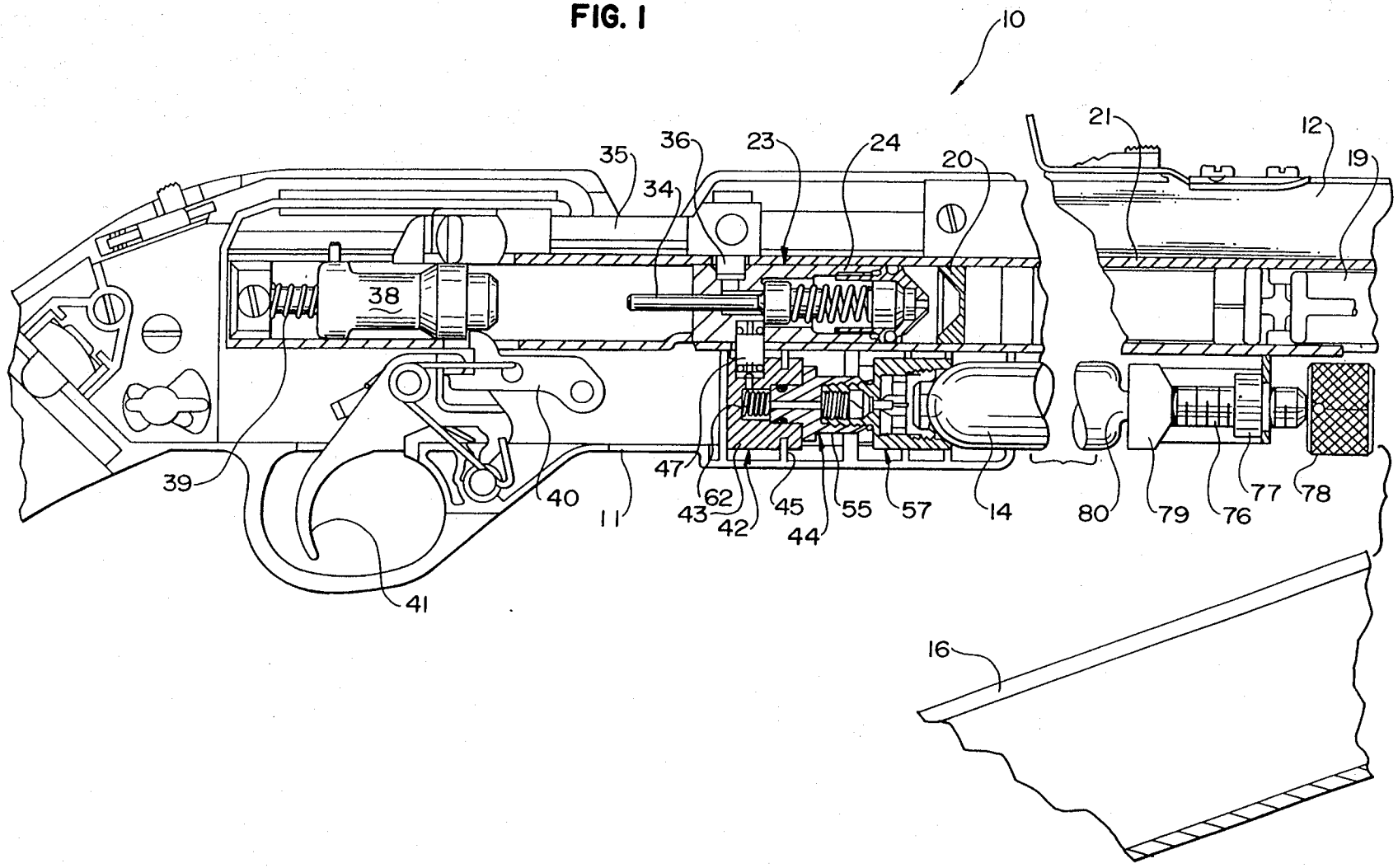
FIGS. 1 and 1A are fragmentary sectional views illustrating a gun formed in accordance with the invention which is being operated in the air mode.

The numeral 10 designates generally a rifle which includes a frame or receiver 11, a stock (not shown) which is secured to the receiver, and a barrel 12. The gun may be powered by pressurized air which is supplied by a hand pump assembly 13 (FIGS. 1 and 1A), by pressurized $CO_2$ which is supplied by a $CO_2$ cartridge 14 (FIG. 3), or both pressurized air and $CO_2$. The details of the receiver and other parts of the gun which are not specifically described herein are conventional and well known.

Air Mode

The air-powered mode of the gun is substantially the same as the air gun which is described in U.S. Pat. No. 4,304,213, and a detailed description of the air-powered mode is unnecessary. A hand grip 16 is pivotally secured to the receiver pin 17, and a link 18 is pivotally secured to the hand grip and to a piston 19. A gasket 20 is carried by the piston and sealingly engages the wall of a pumping tube 21 which is mounted on the receiver.

Figure 8:
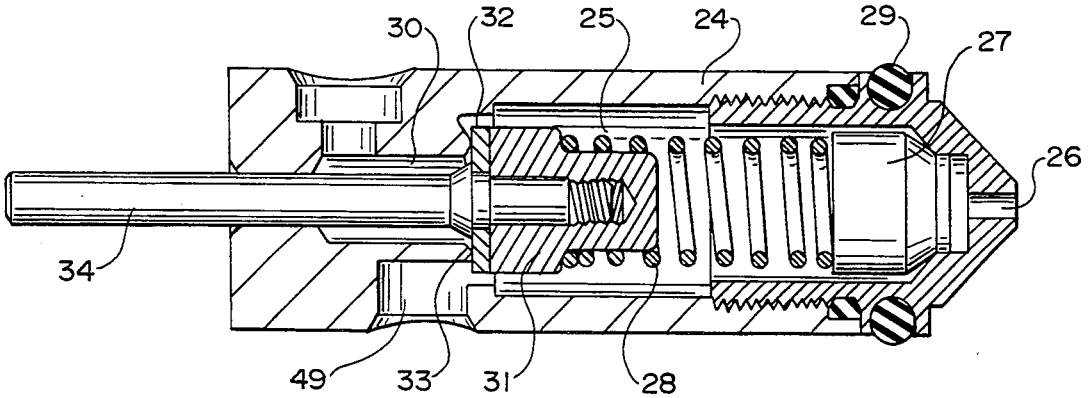
FIG. 8 is a sectional view of the valve body.

A valve assembly 23 is mounted in the receiver for storing pressurized air or gas until the gun is fired. The valve assembly includes a valve body 24 which is mounted within the pumping tube 21 and which is provided with a pressure reservoir or chamber 25 (FIG. 8). The end of the valve body which faces the piston 19 is provided with an air inlet 26, and the inlet is normally closed by a check valve 27 which is resiliently biased against a conical seat within the valve body by a spring 28. An 0-ring 29 provides an air seal between the inlet end of the valve body and the pumping tube 21.

A discharge port 30 in the other end of the valve body is normally closed by a plunger 31 which is also resiliently biased by the spring 28. The plunger 31 includes a resilient sealing ring 32 which engages a valve seat 33 (FIG. 8) on the valve body and a stem 34 which extends through the valve body for engagement by the firing mechanism of the gun.

The pressure reservoir within the valve body 24 is pressurized with air by pivoting the hand grip 16. Each time the piston is moved toward the valve body, air is compressed by the piston and forced past the check valve 27 into the pressure reservoir. The pressure within the reservoir is thereby increased each time the hand grip is pumped.

As described in U.S. Pat. No. 4,304,213, a projectile such as a BB is loaded into the breech end of the barrel 12 by a bolt 35. The bolt positions the BB just forwardly of a port 36 which communicates with the discharge port 30 of the valve body.

The firing mechanism includes a hammer 38 which is slidably mounted in the rear end of the pumping tube 21. The hammer is resiliently biased to the right by a hammer spring 39. The hammer may be retracted to the left to a firing position by a lever on the bolt assembly. The hammer is maintained in the firing position by a sear 40. The sear is pivotable by a trigger 41 for releasing the hammer, and the hammer spring drives the hammer toward the stem 34 of the plunger 31. When the plunger 31 is moved to the right, the sealing ring 32 on the plunger is removed from the valve seat 33, and pressurized air flows from the reservoir through the port 36 to propel the BB.

$CO_2$ Mode

Figure 3:
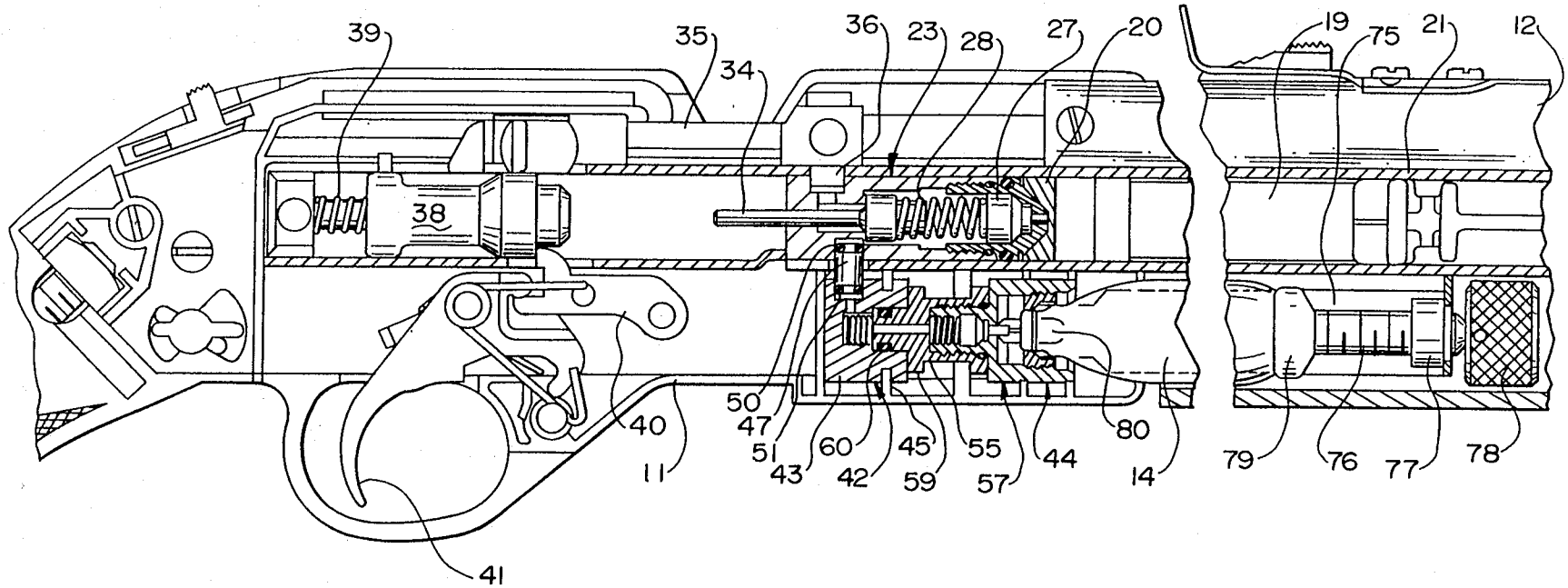
FIG. 3 is a view similar to FIGS. 1 and 2 illustrating the gun being operated in the $CO_2$ mode.
Figure 7:
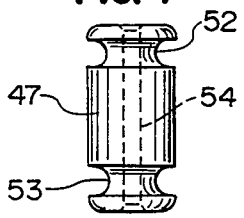
FIG. 7 is an elevational view of the transfer body.
Figure 5:
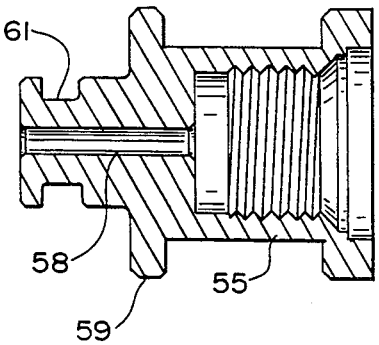
FIG. 5 is a sectional view of the plunger.
Figure 6:
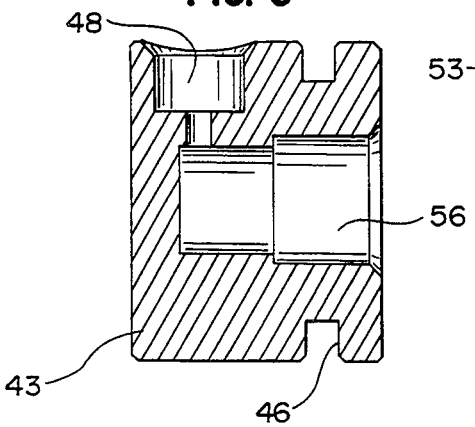
FIG. 6 is a sectional view of the exhaust body of the adapter assembly.

Referring to FIG. 3, a $CO_2$ adapter assembly 42 is mounted on the receiver 11 and includes an adapter housing or exhaust body 43 and a plunger assembly 44. The adapter housing is generally cylindrical and extends through an opening in a wall 45 which is provided in the mating halves of the receiver. The position of the adapter housing is fixed by an annular groove 46 (FIG. 6) in the housing which is engaged by the wall 45 of the receiver. A tubular transfer body 47 (FIG. 7) extends between opening 48 in the adapter housing and opening 49 (FIG. 8) in the valve body 24. O-rings 50 and 51 are positioned in annular grooves 52 and 53 in the transfer body and provide gas-tight seals with the adapter housing and valve body. The transfer body is provided with a bore 54 which provides communication between the pressure reservoir 25 of the valve body and the internal bore of the adapter housing.

Referring to FIGS. 1, 2 and 4–6, the plunger assembly 44 includes a plunger 55 which is slidably mounted within an internal bore 56 of the adapter housing 43 and a cartridge-piercing assembly 57. The plunger 55 is provided with a bore 58 and a radial flange 59 which is engageable with the adapter housing to limit sliding movement of the plunger. An O-ring 60 is mounted in an annular groove 61 and provides a gas-tight seal between the plunger and the adapter housing. A spring 62 inside the adapter housing resiliently biases the plunger to the right.

Figure 4:
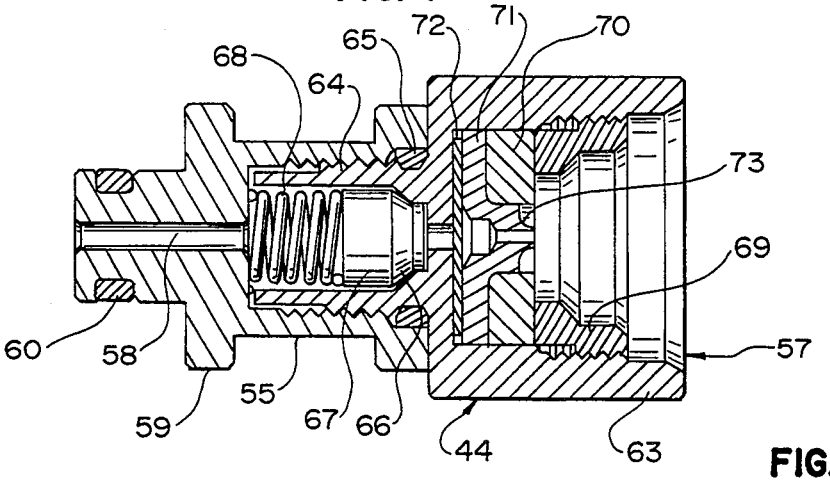
FIG. 4 is an enlarged sectional view of the plunger assembly.

Referring to FIG. 4, the cartridge-piercing assembly 57 includes a tubular housing 63 which has an externally threaded nipple 64 which is screwed into the plunger 55 and which is sealed by O-ring 65. The interior of the nipple 64 is provided with a conical valve seat 66, and a check valve 67 is biased against the valve seat by a spring 68.

A cylindrical guide collar 69 is screwed into the large end of the housing 63 and bears against an annular sealing gasket 70, a piercing pin 71, and a disc-shaped screen 72. The inside surface of the guide collar is shaped to mate with the end of the $CO_2$ cartridge 14, and the seal on the end of the cartridge is pierced by a sharp portion 73 on the piercing pin 71.

Figure 2:
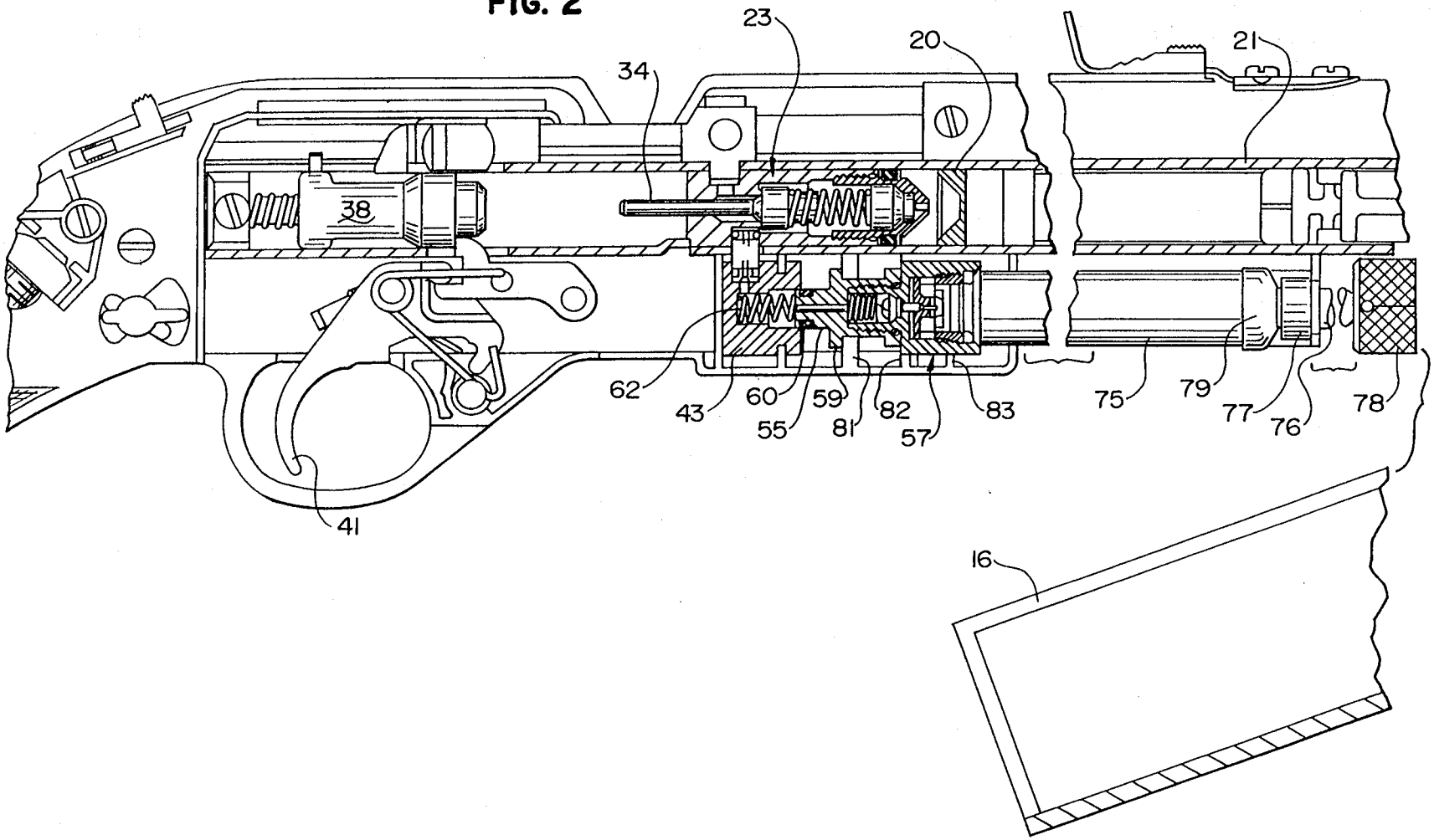
FIG. 2 is a view similar to FIG. 1 showing the gun without a $CO_2$ cartridge and the $CO_2$ adapter assembly in the exhaust mode.

Referring to FIGS. 2 and 3, a generally U-shaped cartridge bracket 75 is mounted on the receiver in front of the cartridge-piercing assembly 57. A screw 76 is threadedly engaged with a nut 77 on the bracket. A knob 78 is mounted on one end of the screw, and a pusher pad 79 is mounted on the other end. The pad 79 is provided with a concave surface for engaging the round end of a $CO_2$ cartridge 14.

The gun is used in the $CO_2$ mode by inserting a $CO_2$ cartridge 14 into the cartridge bracket 75. Such $CO_2$ cartridges are conventional and include a tapered neck portion 80 (FIG. 3) which is inserted into the guide collar 69 in the piercing assembly 57. The neck portion is thereby centered with respect to the piercing pin 71, and as the screw 76 is screwed toward the piercing assembly, the top of the neck portion is forced against the sealing gasket 70. A seal in the neck portion of the cartridge is pierced by the piercing pin, and pressurized $CO_2$ flows from the cartridge past the check valve 67 and into the pressure reservoir 25 in the valve body. When the gun is fired, the hammer 38 strikes the stem 34 of the plunger 31 to release a charge of pressurized gas as previously described.

When the $CO_2$ cartridge is forced against the piercing assembly 57, the plunger 55 is maintained in its sealing position illustrated in FIG. 3. The flange 59 of the plunger is maintained against the adapter housing 43, and the O-ring 60 on the plunger maintains a gas-tight seal between the plunger and the adapter housing. When the $CO_2$ cartridge is removed, the spring 62 in the adapter housing moves the plunger to the right to an exhaust position in which the O-ring 60 moves outside of the adapter housing as illustrated in FIG. 2. Pressurized gas or air can then flow out of the pressure reservoir in the valve body past the O-ring 60 to relieve the pressure in the pressure reservoir.

The rightward movement of the plunger in FIG. 2 is limited by engagement of the flange 59 with a wall 81 which is provided by the mating halves of the receiver. The plunger and the cartridge-piercing assembly are maintained in axial alignment with the adapter housing 43 by openings in the wall 81 and walls 82 and 83.

$CO_2$ and Air Mode

The gun can be powered by both $CO_2$ and pressurized air if it is desired to provide a greater discharge force than is available from $CO_2$ alone. A $CO_2$ cartridge is loaded into the cartridge bracket and pressurizes the pressure reservoir. The pressure in the reservoir can be increased by operating the hand pump 16. The piston 19 will pump pressurized air into the pressure reservoir past the check valve 27. The check valve 27 and the check valve 67 in the cartridge-piercing assembly 57 will maintain the pressure in the reservoir until the gun is fired.

If the gun is operated in the $CO_2$ mode and the $CO_2$ cartridge becomes empty, the gun can thereafter be operated in the air mode without removing the cartridge. The pressure reservoir is pressurized by the hand pump 16, and the check valve 67 in the adapter cartridge-piercing assembly prevents pressurized air from flowing into the empty $CO_2$ cartridge.

Figure 1A:
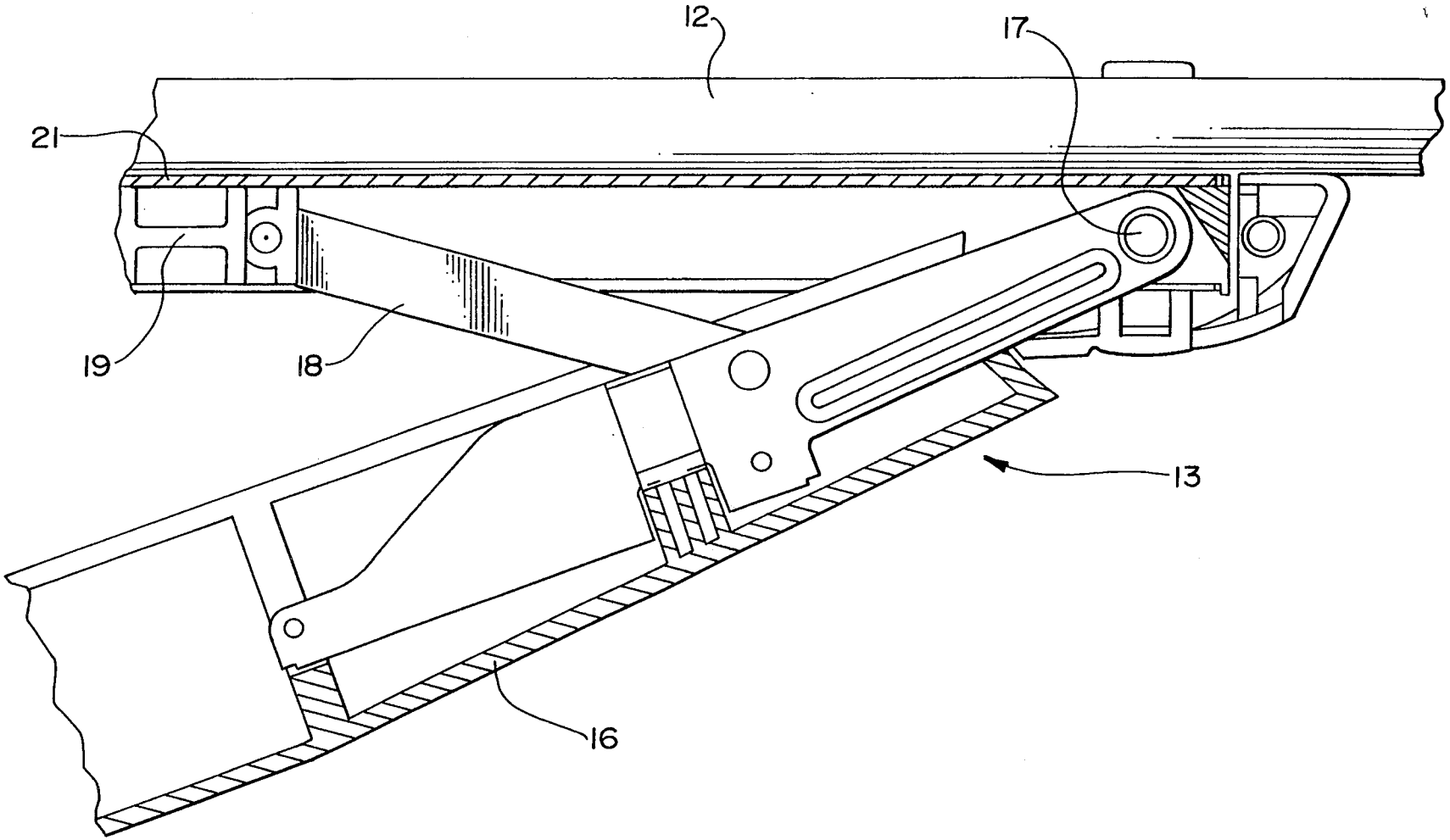

FIG. 1 illustrates the gun being operated in the air mode without piercing the $CO_2$ cartridge 14. The position of the $CO_2$ cartridge is reversed so that the tapered top end 80 engages the pusher pad 79 and the rounded bottom end engages the end of the housing 63 of the piercing assembly 57. The diameter of the bottom end of the cartridge is greater than the inside diameter of the housing 63, and the cartridge will not engage the needle 71. However, the screw 76 forces the cartridge against the housing 63 so that the plunger 55 is maintained in its sealing position inside of the adapter housing 43.

FIGS. 9–12 illustrate a modified gun 110 which includes a $CO_2$ adapter assembly 144 which is mounted perpendicuarly with respect to the pumping tube 121. The gun 110 otherwise corresponds to the gun 10.

Figure 15:
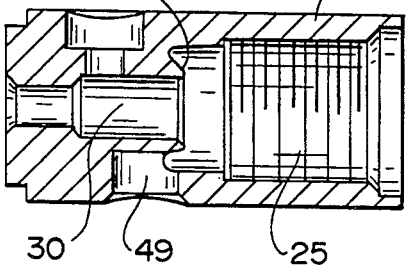
FIG. 15 is a sectional view of the valve body.

The $CO_2$ adapter assembly 144 is mounted on the receiver 11 and includes an adapter housing 145, a tubular cartridge housing 146, and a plug 147. The adapter housing is generally cylindrical and extends through an opening 148 which is provided in the mating halves of the receiver. The position of the adapter housing is fixed by an annular groove 149 (FIG. 13) in the housing which is engaged by the edge of the opening 148 in the receiver. The upper end of the adapter housing includes a nipple 150 which extends through the opening 49 in the valve body 24 (FIG. 15). An O-ring 152 on the nipple provides a gas-tight seal with the valve body. The nipple is provided with a bore 153 which provides communication between the pressure reservoir and the internal bore of the adapter housing.

Figure 13:
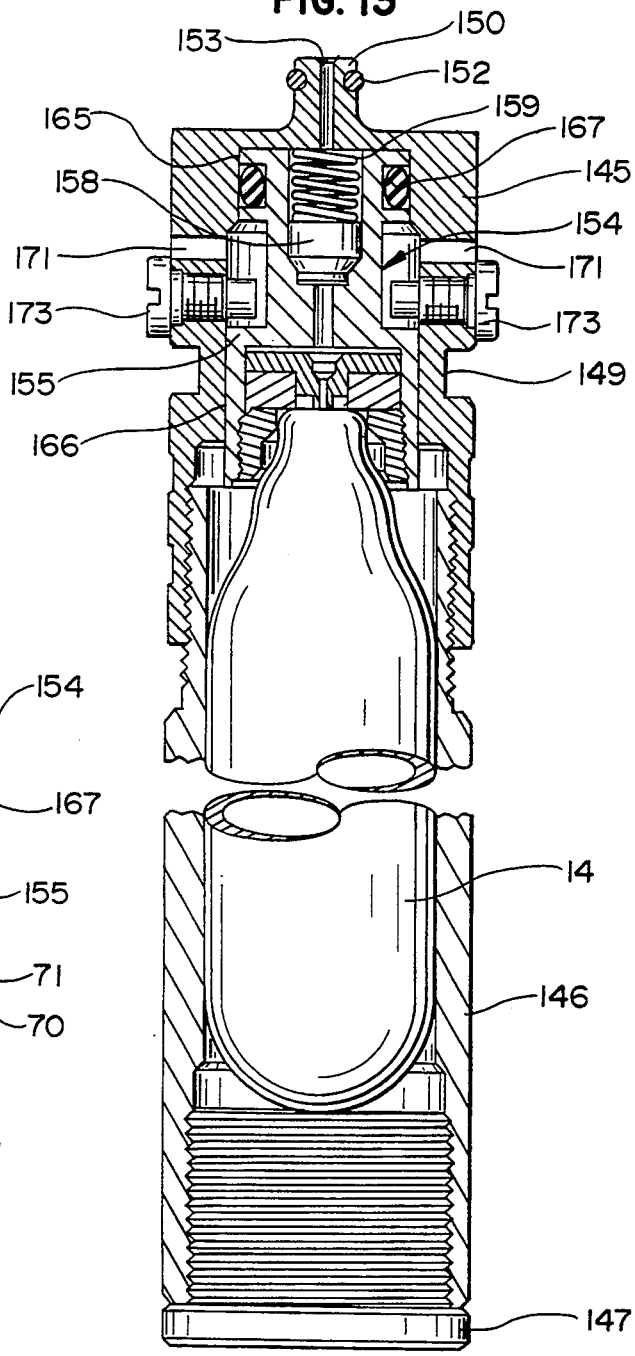
FIG. 13 is an enlarged sectional view of the $CO_2$ adapter assembly.
Figure 14:
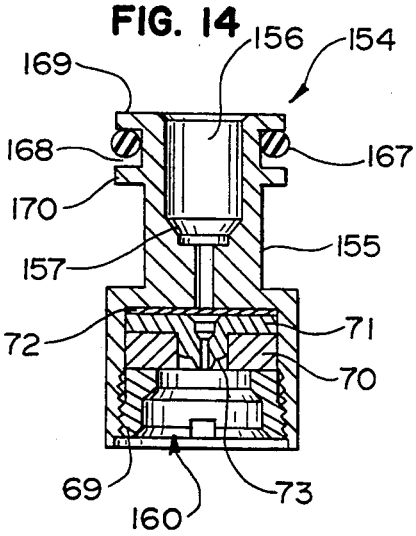
FIG. 14 is a sectional view of the plunger assembly.

Referring to FIGS. 13 and 14, a plunger assembly 154 is slidably mounted within the internal bore of the adapter housing 145. The plunger assembly 154 includes a plunger 155 which is provided with an internal bore 156. A portion of the bore provides a conical valve seat 157, and a check valve 158 is biased against the valve seat by a spring 159.

A cartridge-piercing assembly 160 (FIG. 14) is mounted within the plunger. The piercing assembly 160 is substantially identical to the piercing assembly 57.

The internal bore of the adapter housing 145 is provided by an upper cylindrical portion 165 and a second cylindrical portion 166 which has a greater diameter than the portion 165. An O-ring 167 is positioned in an annular groove 168 which is provided by a pair of flanges 169 and 170 at the upper end of the plunger 155. When the plunger is in its sealing position illustrated in FIG. 13, the O-ring 167 seals against the cylindrical wall 165 of the adapter housing and prevents pressurized gas or air from flowing from the pressure reservoir to exhaust ports 171 which are provided through the enlarged cylindrical wall 166 of the adapter housing. The plunger is maintained in the sealing position by the $CO_2$cartridge 14, which is forced upwardly by the threaded plug 147 which screws into the bottom of the cartridge housing 146.

When the $CO_2$ cartridge is removed, the plunger is free to move downwardly to an exhaust position illustrated in FIG. 12 in which the O-ring 167 moves below the top portion 165 of the bore of the adapter housing 145 and is positioned within the larger diameter portion 166 of the bore of the adapter housing. Pressurized gas or air can then flow out of the pressure reservoir past the O-ring and through the exhaust ports 171 to relieve the pressure in the pressure reservoir.

The plunger assembly 154 is retained within the adapter housing 145 by a pair of retaining screws 173 which are screwed into threaded openings in the adapter housing below the exhaust port 171. The flange on the plunger is engageable with the retaining screws to prevent the plunger from moving downwardly below the exhaust position.

Figure 11:
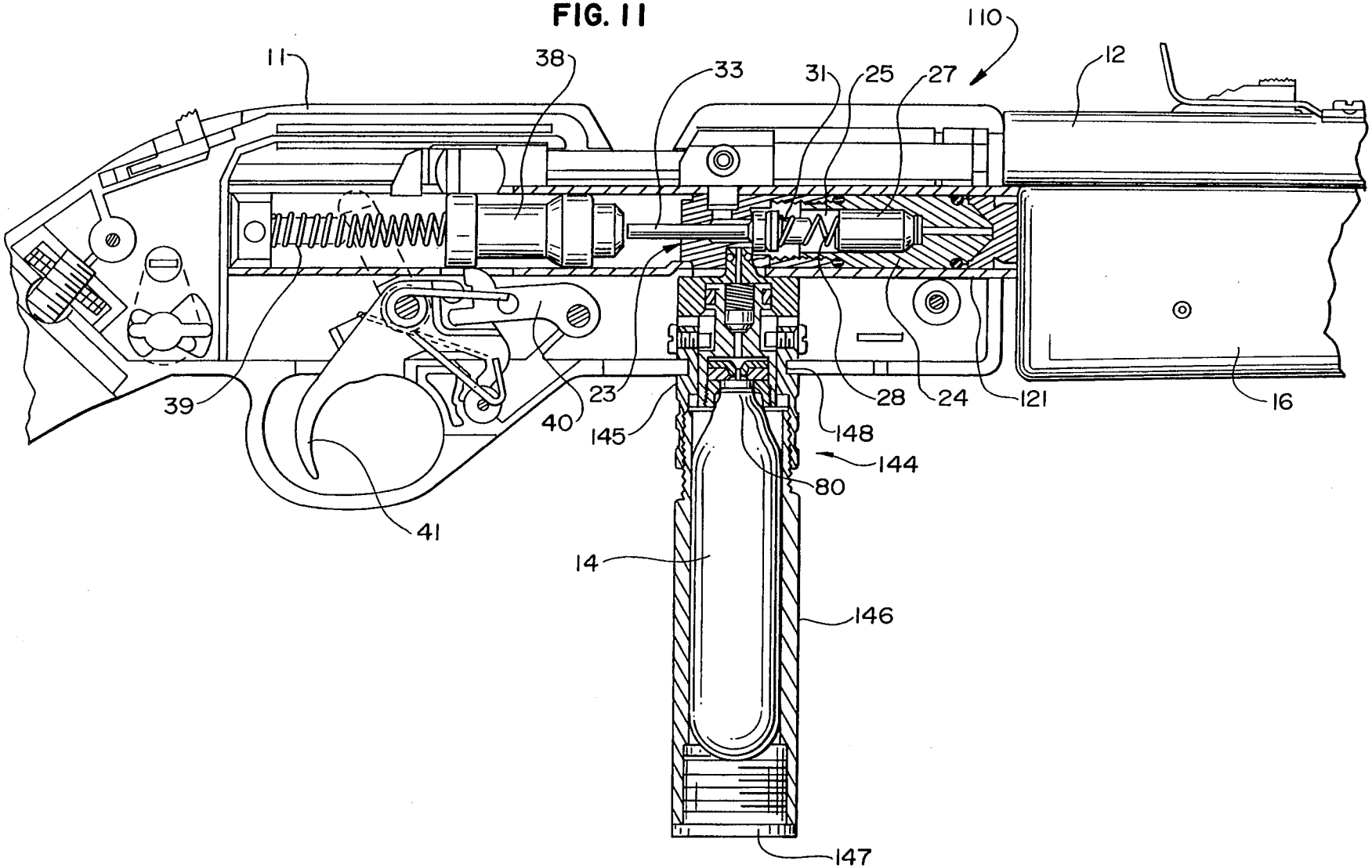
FIG. 11 is a view similar to FIGS. 9 and 10 illustrating the gun being operated in the $CO_2$ mode.

The gun 110 is used in the $CO_2$ mode by inserting a $CO_2$ cartridge into the cartridge housing as illustrated in FIG. 11. The cartridge is pierced by the piercing assembly 160, and pressurized $CO_2$ flows past the check valve 158 into the pressure reservoir 25 in the valve body 24.

Figure 12:
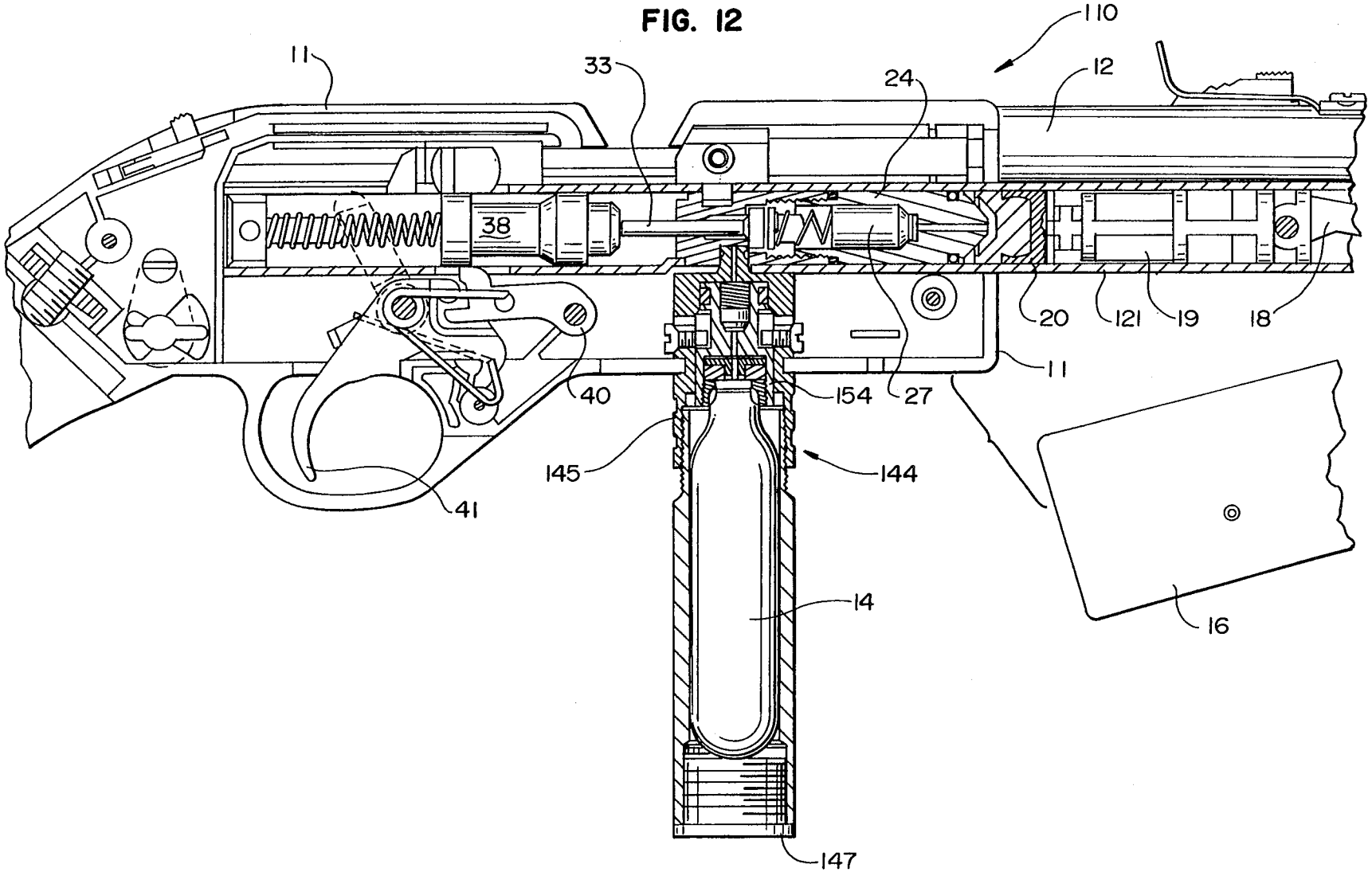
FIG. 12 is a view similar to FIGS. 9 and 11 illustrating the gun being operated in the $CO_2$ and air mode.

The gun 110 can be powered by both $CO_2$ and pressurized air by operating the hand pump 116 (FIG. 12).

Figure 9:
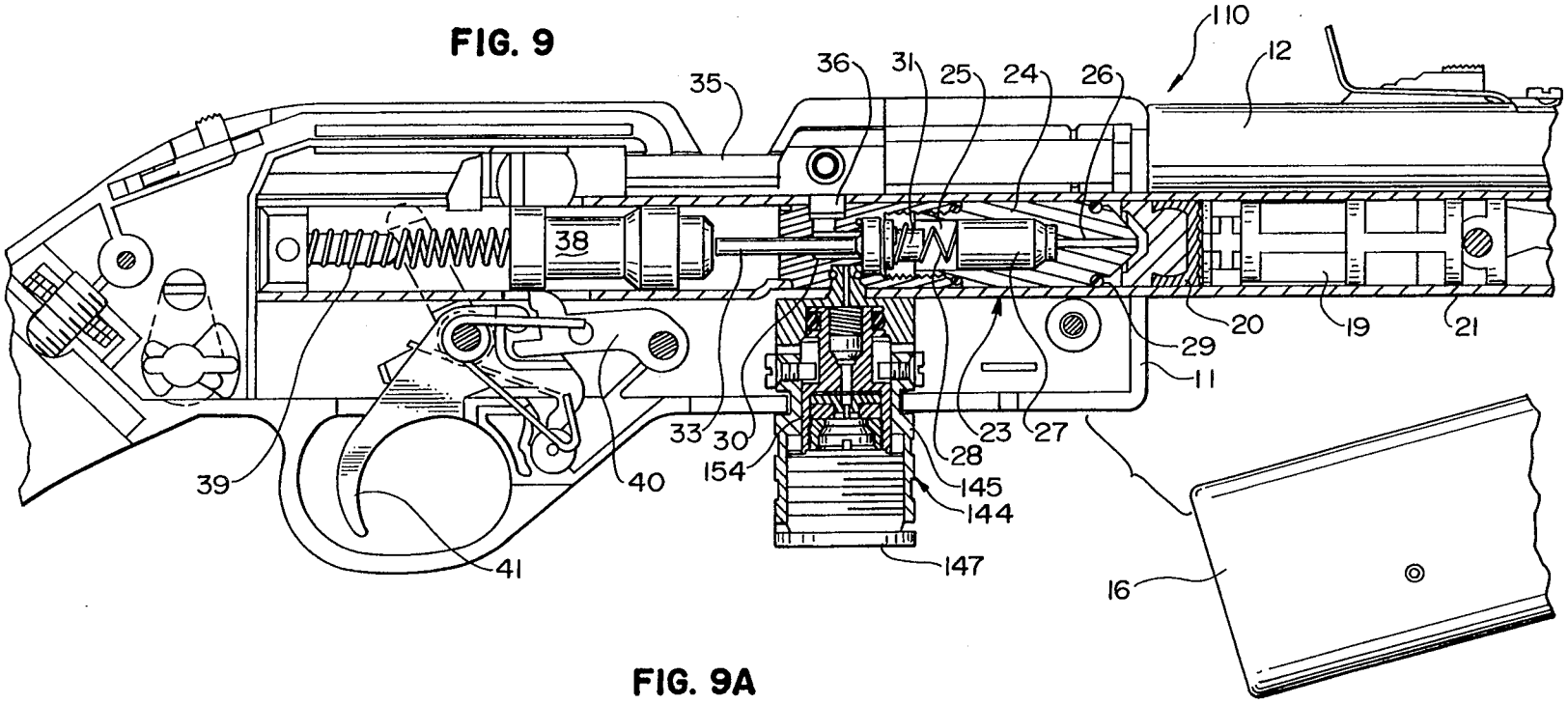
FIGS. 9 and 9A illustrate a modified gun in which a $CO_2$ adapter assembly is mounted vertically under the pumping mechanism and the gun is operated in the air mode.
Figure 9A:
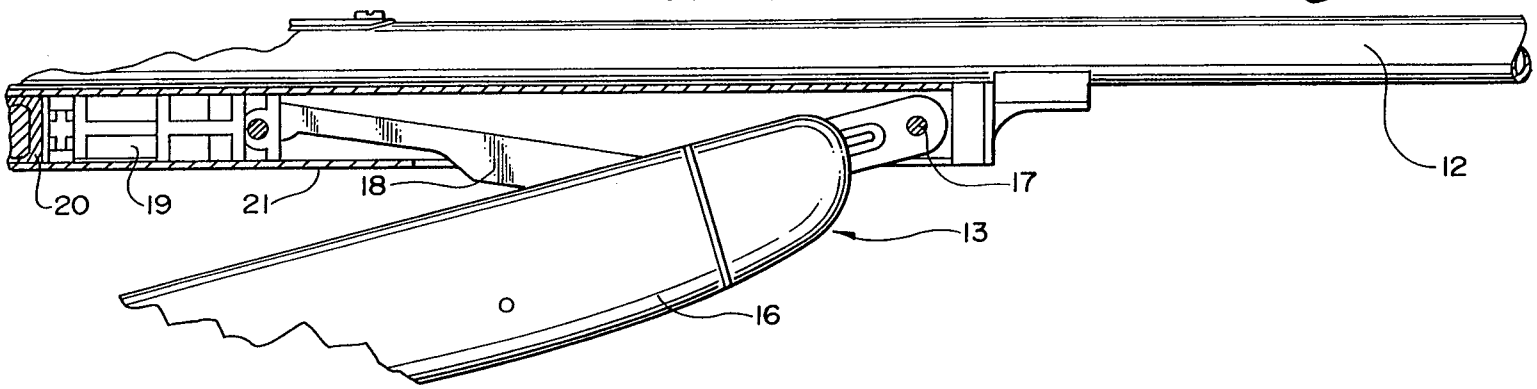
Figure 10:
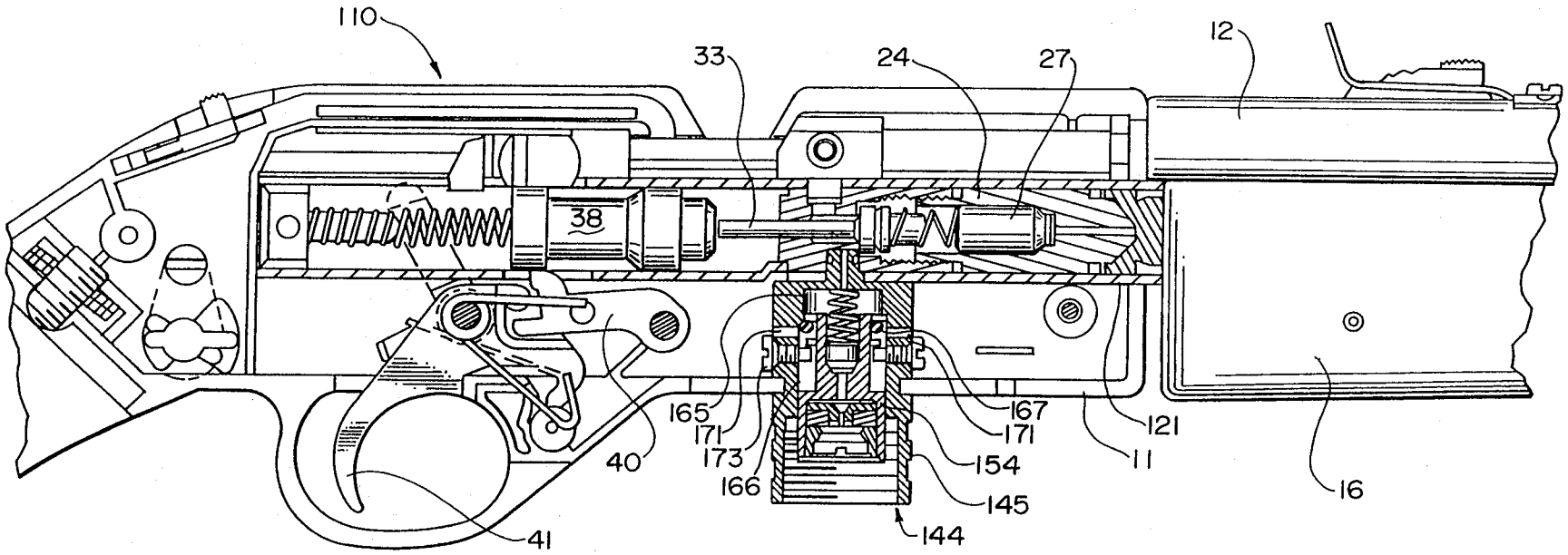
FIG. 10 is a view similar to FIG. 9 showing the gun without a $CO_2$ cartridge and the $CO_2$ adapter assembly in the exhaust mode.

The gun can also be operated in the air mode with the $CO_2$ cartridge removed. The threaded upper end of the cartridge housing 146 is unscrewed from the adapter housing 145, and the threaded plug 147 is screwed into the adapter housing as illustrated in FIG. 9. The plug engages the bottom of the plunger assembly 154 and maintains the plunger assembly in the sealing position. The pressure reservoir can be depressurized by unscrewing the plug to permit the plunger assembly to move downwardly to the exhaust position, thereby allowing pressurized air to flow past the O-ring 167 and through the exhaust port 171.

Figures 16, 17:
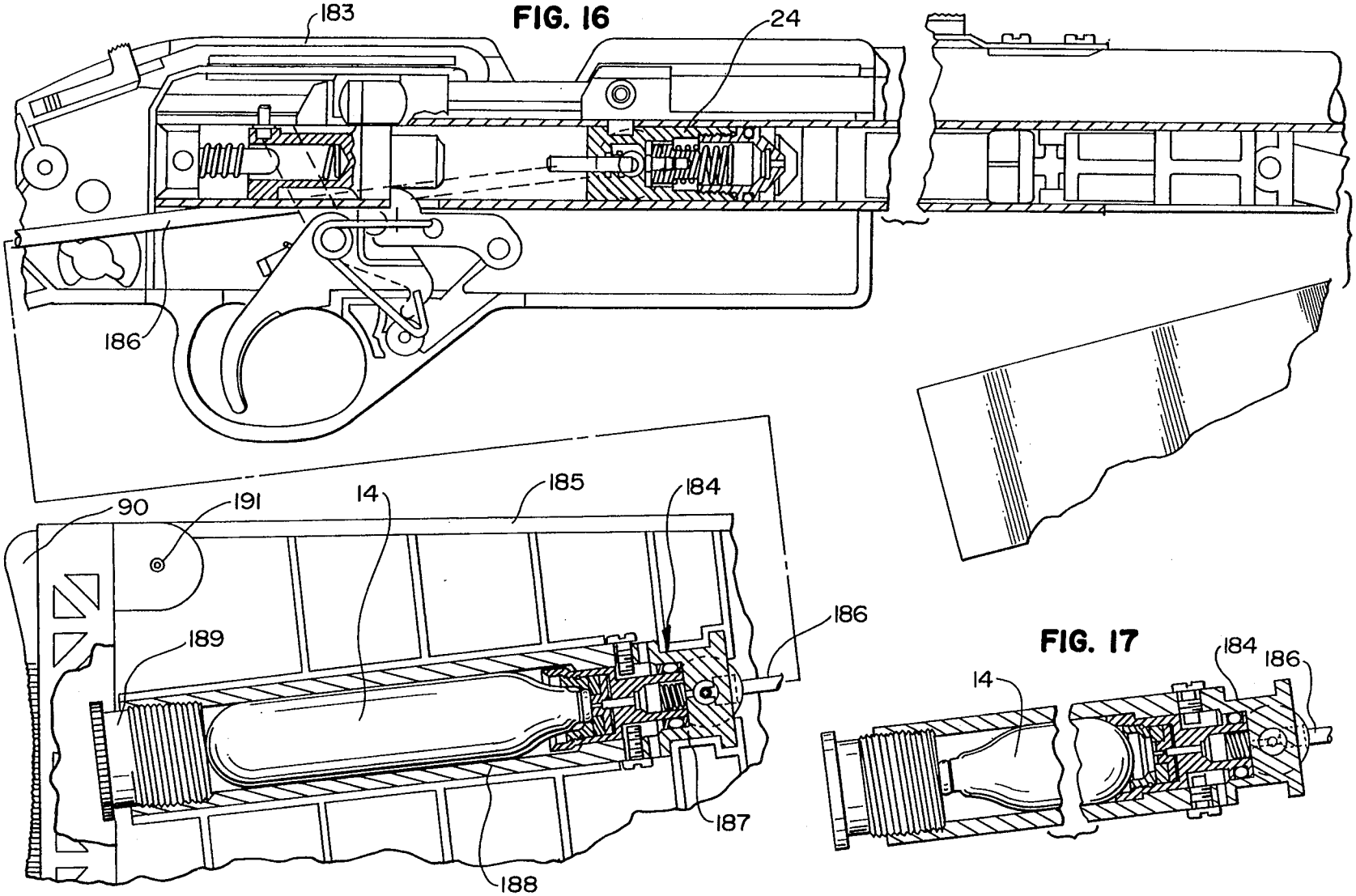
FIG. 16 illustrates another embodiment of the gun in which the adapter assembly is mounted in the stock.
FIG. 17 illustrates the adapter assembly of FIG. 16 with the $CO_2$ cartridge being reversed so that the gun can be operated in the air mode.

FIG. 16 illustrates another embodiment of a gun 183 in which a $CO_2$ adapter assembly 184 is mounted in the stock 185 of the gun. The $CO_2$ adapter assembly communicates with the valve body 24 through a tube 186. Except for the position of the adapter assembly and the construction of the stock, the gun 183 is identical to the gun 10.

The adapter assembly 184 includes an adapter housing 187 which is similar to the adapter housing 145 but also includes a cylindrical cartridge-holding portion 188. The adapter assembly 184 includes a plunger assembly which is identical to the plunger assembly 154, and a $CO_2$ cartridge 14 is forced against the plunger assembly to maintain the plunger assembly in its sealing position by a threaded plug 189 which is screwed into the end of the cartridge-holding portion 188. The stock 185 includes a butt plate 190 which is pivotally secured to the stock by a pin 191 so that the butt plate can pivot to provide access to the adapter assembly.

FIG. 17 illustrates the adapter assembly 184 being operated in the air mode by reversing the $CO_2$ cartridge 14. The $CO_2$ cartridge can be an empty cartridge or one which has not yet been pierced.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A gun which may be powered by a cartridge of pressurized gas or by pressurized air comprising:

a frame, a barrel mounted on the frame, a valve body on the frame having a pressure reservoir for storing pressurized gas or pressurized air, firing means for releasing pressurized gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or gas from leaving the pressure reservoir, and an adapter assembly mounted on the gun for holding a gas cartridge, the adapter assembly communicating with the pressure reservoir and including a check valve for permitting pressurized gas to enter the pressure reservoir, the adapter assembly an adapter housing, a plunger slidably mounted in the adapter housing and movable between a sealing position in which the plunger is sealing engaged with the adapter housing and an exhaust position in which pressurized air or gas in the pressure reservoir can flow out of the adapter assembly.

2. A gun which may be powered by a cartridge of pressurized gas or by pressurized air comprising:

a frame, a barrel mounted on the frame, a valve body on the frame having a pressure reservoir for storing pressurized gas or pressurized air, firing means for releasing pressurized gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or gas from leaving the pressure reservoir, and an adapter assembly mounted on the gun for holding a gas cartridge, the adapter assembly communicating with the pressure reservoir and including a check valve for permitting pressurized gas to enter the pressure reservoir, the adapter assembly an adapter housing, a plunger slidably mounted in the adapter housing and movable between a sealing position in which the plunger is sealingly engaged with the adapter housing and an exhaust position in which pressurized air or gas in the pressure reservoir can flow out of the adapter assembly, the plunger being maintained in the sealing position by a gas cartridge when a cartridge is positioned in the adapter assembly.

3. A gun which may be powered by a cartridge of pressurized gas or by pressurized air comprising:

a frame, a barrel mounted on the frame, a valve body on the frame having a pressure reservoir for storing pressurized gas or pressurized air, firing means for releasing pressurized gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or gas from leaving the pressure reservoir, and an adapter assembly mounted on the gun for holding a gas cartridge, the adapter assembly communicating with the pressure reservoir and including a check valve for permitting pressurized gas to enter the pressure reservoir, the adapter assembly an adapter housing, a plunger slidably mounted in the adapter housing and movable between a sealing position in which the plunger is sealingly engaged with the adapter housing and an exhaust position in which pressurized air or gas in the pressure reservoir can flow out of the adapter assembly, and a piercing pin on the plunger for piercing a gas cartridge.

4. The gun of claim 3 including a cartridge assembly for holding a gas cartridge and forcing a gas cartridge against said piercing pin.

5. A gun which may be powered by a cartridge of pressurized gas or by pressurized air comprising:

a frame, a barrel mounted on the frame, a valve body on the frame having a pressure reservoir for storing pressurized gas or pressurized air, firing means for releasing pressurized gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or gas from leaving the pressure reservoir, and an adapter assembly mounted on the gun for holding a gas cartridge, the adapter assembly communicating with the pressure reservoir and including a check valve for permitting pressurized gas to enter the pressure reservoir, the adapter assembly an adapter housing, a plunger slidably mounted in the adapter housing and movable between a sealing position in which the plunger is sealingly engaged with the adapter housing and an exhaust position in which pressurized air or gas in the pressure reservoir can flow out of the adapter assembly, and a spring for biasing the plunger to the exhaust position.

6. A gun which may be powered by a cartridge of pressurized gas or by pressurized air comprising:

a frame, a barrel mounted on the frame, a valve body on the frame having a pressure reservoir for storing pressurized gas or pressurized air, firing means for releasing pressurized gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or gas from leaving the pressure reservoir, and an adapter assembly mounted on the gun for holding a gas cartridge, the adapter assembly communicating with the pressure reservoir and including a check valve for permitting pressurized gas to enter the pressure reservoir, the adapter assembly an adapter housing, a plunger slidably mounted in the adapter housing and movable between a sealing position in which the plunger is sealingly engaged with the adapter housing and an exhaust position in which pressurized air or gas in the pressure reservoir can flow out of the adapter assembly, and a tube having one end which is threadedly attached to the adapter housing for enclosing a gas cartridge and a plug which is threadedly attached to the other end of the tube for maintaining the cartridge within the tube.

7. The gun of claim 6 in which the plunger is maintained in the sealing position by a gas cartridge and the plug when a cartridge is positioned in the tube.

8. The gun of claim 6 including a piercing pin on the plunger for piercing a gas cartridge.

9. A gun which may be powered by a cartridge of pressurized gas or by pressurized air comprising:

a frame, a barrel mounted on the frame, a valve body on the frame having a pressure reservoir for storing pressurized gas or pressurized air, firing means for releasing pressurized gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or gas from leaving the pressure reservoir, and an adapter assembly mounted on the gun for holding a gas cartridge, the adapter assembly communicating with the pressure reservoir and including a check valve for permitting pressurized gas to enter the pressure reservoir, the adapter assembly an adapter housing, a plunger slidably mounted in the adapter housing and movable between a sealing position in which the plunger is sealingly engaged with the adapter housing and an exhaust position in which pressurized air or gas in the pressure reservoir can flow out of the adapter assembly, and a plug which is threadedly attached to the adapter housing and engages the plunger for maintaining the plunger in the sealing position.

10. A gun which may be powered by a cartridge of pressurized gas or by pressurized air comprising:

a frame, a barrel mounted on the frame, a valve body on the frame having a pressure reservoir for storing pressurized gas or pressurized air, firing means for releasing pressurized gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or gas from leaving the pressure reservoir, and an adapter assembly mounted on the gun for holding a gas cartridge, the adapter assembly communicating with the pressure reservoir and including a check valve for permitting pressurized gas to enter the pressure reservoir, the adapter assembly an adapter housing, a plunger slidably mounted in the adapter housing and movable between a sealing position in which the plunger is sealingly engaged with the adapter housing and an exhaust position in which pressurized air or gas in the pressure reservoir can flow out of the adapter assembly, and an O-ring positioned in a groove in the plunger, the adapter housing being provided with an internal bore in which the plunger is slidably mounted, the bore having a first portion which sealingly engages the O-ring when the plunger is in the sealing position and a second portion which is larger than the first portion whereby the O-ring does not seal against the adapter housing when the plunger is in the exhaust position, the exhaust port being positioned in the second portion of the bore.

11. The gun of claim 10 including a retaining pin retaining pin being engageable with the plunger to maintain the plunger within the adapter housing.

12. A gun which may be powered by a cartridge of pressurized gas or by pressurized air comprising:

a frame, a barrel mounted on the frame, a valve body on the frame having a pressure reservoir for storing pressurized gas or pressurized air, firing means for releasing pressurized gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or gas from leaving the pressure reservoir, and an adapter assembly mounted on the gun for holding a gas cartridge, the adapter assembly communicating with the pressure reservoir and including a check valve for permitting pressurized gas to enter the pressure reservoir, the adapter assembly an adapter housing, a plunger slidably mounted in the adapter housing and movable between a sealing position in which the plunger is sealingly engaged with the adapter housing and an exhaust position in which pressurized air or gas in the pressure reservoir can flow out of the adapter assembly, the adapter housing being provided with an internal bore in which the plunger is slidably mounted and a port which communicates with the pressure reservoir, the plunger being provided with an internal bore, a portion of the bore of the plunger providing a valve seat, the check valve in the adapter housing being mounted in the bore of the plunger and being resiliently biased against the valve seat, a piercing pin on the plunger for piercing a cartridge of compressed gas whereby compressed gas can flow through the bore of the plunger, past the check valve, and through the port in the adapter assembly to the pressure reservoir.

13. The gun of claim 12 including an O-ring positioned in a groove in the plunger, the bore of the adapter housing sealingly engaging the O-ring when the plunger is in the sealing position.

14. The gun of claim 13 including a retaining pin extending through the adapter housing and into the bore, the retaining pin being engageable with the plunger to maintain the plunger within the adapter housing.

15. The gun of claim 12 in which the plunger is maintained in the sealing position by a gas cartridge when a cartridge is positioned in the adapter assembly.

16. The gun of claim 12 in which the adapter assembly includes a tube having one end which is threadedly attached to the adapter housing for enclosing a gas cartridge and a plug which is threadedly attached to the other end of the tube for maintaining the cartridge within the tube.

17. The gun of claim 16 in which the plunger is maintained in the sealing position by a gas cartridge and the plug when a cartridge is positioned in the tube.

18. The gun of claim 16 including a piercing pin on the plunger for piercing a gas cartridge.

19. The gun of claim 12 in which the adapter assembly includes a plug which is threadedly attached to the adapter housing and engages the plunger for maintaining the plunger in the sealing position.

20. A gun which may be powered by a cartridge of pressurized gas or by pressurized air comprising:

a frame, a barrel mounted on the frame, a valve body on the frame having a pressure reservoir for storing pressurized gas or pressurized air, firing means for releasing pressurized gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or gas from leaving the pressure reservoir, and an adapter assembly mounted on the gun for holding a gas cartridge, the adapter assembly communicating with the pressure reservoir and including a check valve for permitting pressurized gas to enter the pressure reservoir, the adapter assembly an adapter housing, a plunger slidably mounted in the adapter housing and movable between a sealing position in which the plunger is sealingly engaged with the adapter housing and an exhaust position in which pressurized air or gas in the pressure reservoir can flow out of the adapter assembly, the plunger including a radially outwardly extending flang which is engageable with the frame when the plunger is in the exhaust position.

21. The gun of claim 20 in which said radially extending flange on the plunger is engageable with the adapter housing when the plunger is in the sealing position.

22. The gun of claim 21 in which the plunger extends through an opening in the frame and said radially extending flange on the plunger is engageable with the periphery of the opening in the frame when the plungr is in the exhaust position.

23. A gun which may be powered by a cartridge of pressurized $CO_2$ gas or by pressurized air comprising:

a frame, an elongated barrel mounted on the frame, a valve body on the frame having a pressure reservoir for storing pressurized $CO_2$ gas or pressurized air, firing means for releasing pressurized $CO_2$ gas or air from the pressure reservoir to the bore of the barrel when the gun is fired for propelling a projectile out of the barrel, pump means on the frame for supplying pressurized air to the pressure reservoir, a check valve in the valve body for permitting pressurized air supplied by the pump means to enter the pressure reservoir but preventing pressurized air or $CO_2$ gas from leaving the pressure reservoir, and an elongated adapter assembly mounted on the gun between the trigger and the pump means and extending generally transversely to the elongated barrel for holding a $CO_2$ gas cartridge, the adapter assembly communicating with the pressure reservoir and including means for piercing a $CO_2$ gas cartridge and a check valve for permitting pressurized $CO_2$ gas to enter the pressure reservoir.

* * * * *

UNITED STATES PATENT AND TRADEMARK OFFICE

CERTIFICATE OF CORRECTION

PATENT NO. : 5,341,790

DATED : August 30, 1994

INVENTOR(S) : Gary F. Ebert

It is certified that error appears in the above-indentified patent and that said Letters Patent is hereby corrected as shown below:

Col. 6, line 66 change "sealing" to —sealingly—.

Col. 9, line 62 insert —extending through the adapter housing and into the bore, the— after "pin".

Signed and Sealed this

Sixth Day of December, 1994

*Attest:*

Bruce Lehman

BRUCE LEHMAN

*Attesting Officer*

*Commissioner of Patents and Trademarks*